United States Patent [19]

Tuttle

[11] Patent Number: 4,466,600

[45] Date of Patent: Aug. 21, 1984

[54] ROUND PIPE RAIL SYSTEM

[75] Inventor: John T. Tuttle, Indianapolis, Ind.

[73] Assignee: Tuttle Aluminum & Bronze, Inc., Noblesville, Ind.

[21] Appl. No.: 441,438

[22] Filed: Nov. 15, 1982

[51] Int. Cl.[3] ..... E04H 17/14

[52] U.S. Cl. ..... 256/65; 256/21; 403/347

[58] Field of Search ..... 256/65, 59, 66, 21, 256/22, 69, 68; 403/347, 346, 237

[56] References Cited

U.S. PATENT DOCUMENTS 2,431,546 11/1947 Edwards ..... 256/22
2,614,827 10/1952 Peach et al. ..... 256/65 X
2,835,475 5/1958 Eughauser ..... 256/22
2,962,263 11/1960 Cofield ..... 256/22
3,921,960 11/1975 Bright ..... 256/65

FOREIGN PATENT DOCUMENTS 1166344 10/1969 United Kingdom ..... 256/22

*Primary Examiner*—Andrew V. Kundrat
*Attorney, Agent, or Firm*—Woodard, Weikart, Emhardt & Naughton

[57] ABSTRACT

A railing system having a plurality of horizontally extending rails fixedly mounted to vertical posts. The posts extend through the rails and have top ends terminated within the uppermost rail allowing for a continuous one piece construction for each rail. Rivets secure the rails and posts together. In one embodiment, a gasket is positioned in the joint between each post and rail limiting the accumulation of water within the joint.

11 Claims, 4 Drawing Figures

ROUND PIPE RAIL SYSTEM

BACKGROUND OF THE INVENTION

This invention is in the field of rail systems employing round posts and rails. The typical prior rail system includes a number of horizontal rails fixedly fastened to upstanding posts by means of welding, rivets of conventional fastening devices. Two major problems exist with the prior railing systems in that rain water is allowed to accumulate in the components and between the post and rail joint and/or considerable time is required to erect or join together the rails and posts.

Some rail systems include a horizontal sleeve fixedly joined to the opposite ends of aligned rails with the sleeve then having a hole extending therethrough to receive the upstanding posts. This type of rail system requires assembly of the sleeve to the opposite ends of the rails adding to the assembly time. Disclosed herein is an improved rail system which eliminates both of the aforementioned problems. First, the horizontal sleeve is eliminated by extending the upstanding posts through vertical holes provided in the rails. Further, a specially designed gasket is provided between the rails and post joint precluding accumulation of rain water within the joint. A further advantage of the elimination of components in the rail post joint area is the more uniform horizontally extending appearance of the rails.

SUMMARY OF THE INVENTION

One embodiment of the present invention is a railing system comprising a plurality of upstanding tubular posts with bottom ends fixedly mountable at ground level and top ends located thereabove, each of the posts have a constant outside diameter along its entire length and are of one piece construction along its entire length, a plurality of horizontally extending rails including an uppermost rail having downwardly opening apertures complementary in size and receiving the top ends of the posts, each rail beneath the uppermost rail including pairs of holes complementary in size to and through which the posts vertically extend, each of the rails having a constant outside diameter along its entire length and being of one piece construction along its entire length, first rivets securing the uppermost rail to the top ends of the posts, second rivets securing each rail beneath the uppermost rail to the posts between the top ends and the bottom ends and means operable to limit accumulation of rain water between the posts and the rails.

It is an object of the present invention to provide a new and improved rail system.

A further object of the present invention is to provide a new and improved gasket for sealing the joint between horizontal rails and vertical posts in a railing system.

Yet another object of the present invention is to provide a railing system having a unified integral appearance throughout the rails, posts and joints therebetween.

Related objects and advantages of the present invention will be apparent from the following description.

DESCRIPTION OF THE PREFERRED EMBODIMENTS

Figure 1:
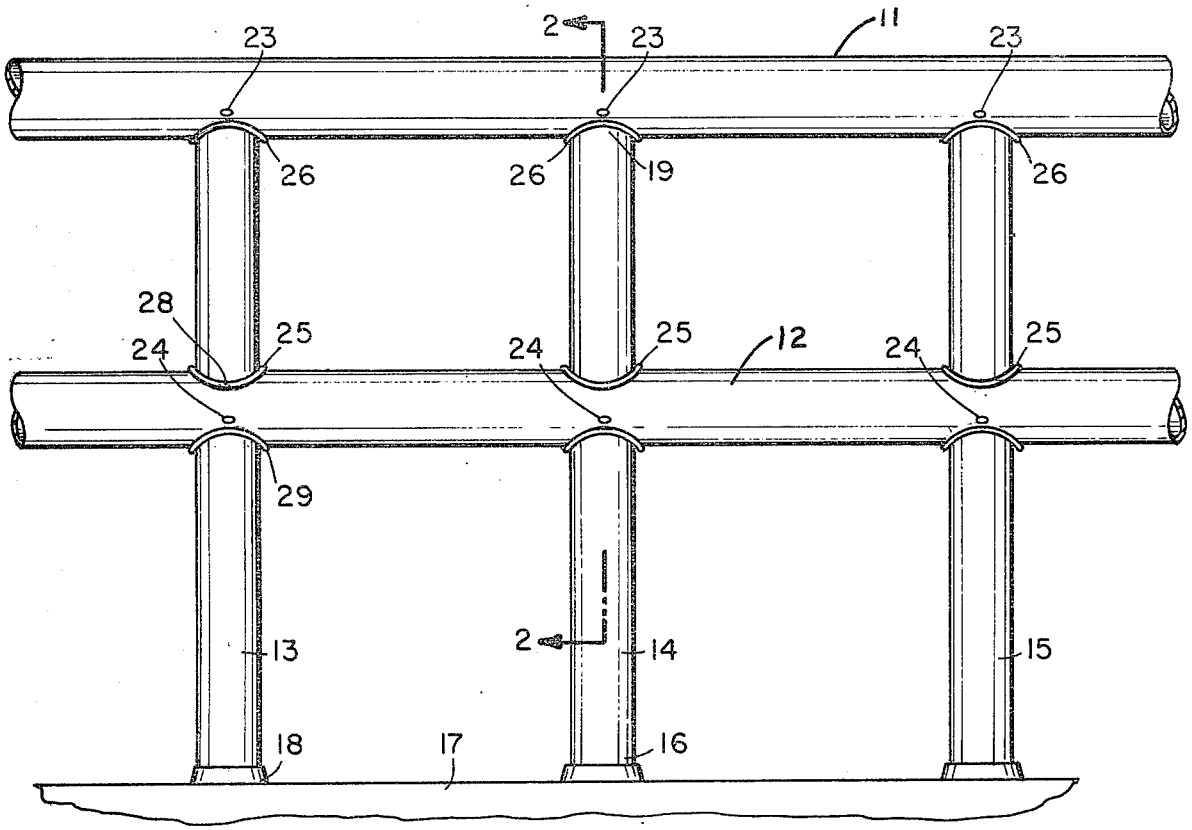
FIG. 1 is a fragmentary side view of a railing system incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a railing system having a plurality of horizontally extending tubular rails 11 and 12 mounted to a plurality of upstanding tubular posts 13, 14 and 15. Posts 13–15 have bottom ends 16 fixedly mounted at ground level 17. Bottom end 16 may be fixedly embedded in ground level 17 or maybe mounted thereto by conventional bracketry 18. Each post 13–15 has a constant outside diameter along its entire length and is of one piece construction from bottom end 16 to the top end 19.

The horizontally extending rails 11 and 12 are arranged so that rail 11 is the uppermost rail and with rail 12 located therebeneath. Additional rails may be located beneath rail 12. Posts 13–15 extend through holes provided in rail 12 and into downwardly opening apertures provided in the uppermost rail 11. The posts and rails are then secured together by means such as rivets.

Figure 2:
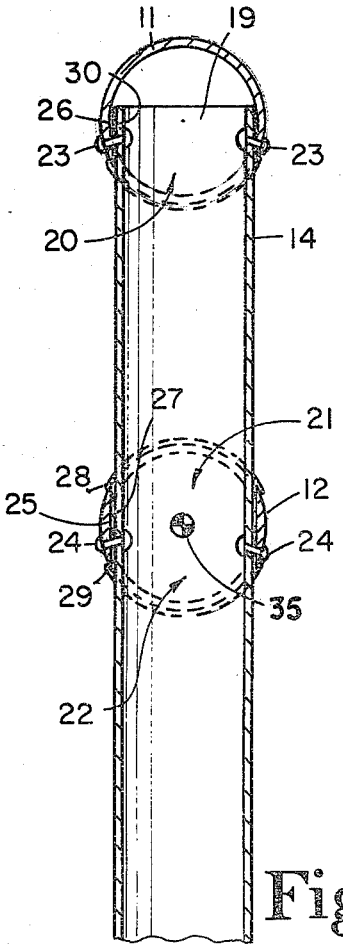
FIG. 2 is an enlarged fragmentary cross-sectional taken along the line 2—2 of FIG. 1 and viewed in the direction of the arrows.

Rail 11 is hollow and includes a plurality of downwardly opening apertures 20 which are complementary in size to receive the top ends 19 of posts 13–15. The rail or rails beneath top rail 11 include pairs of holes complementary in size to and through which the vertical posts extend. For example, rail 12 includes an upwardly opening hole 21 and a downwardly opening hole 22 aligned with hole 21 through which post 14 extends. Thus, each rail may have a constant outside diameter along its entire length with a vertical post extending therethrough except for the top rail in which case the posts terminate inside the top rail. Each rail may therefore be of a one piece construction as is the case for each vertical post. A plurality of rivets 23 secure the uppermost rail 11 to the top ends 19 of the vertical post whereas additional rivets 24 secure each rail 12 beneath the upper rail 11 to the vertical post at a location between the top end and bottom end of the post. Rivets 23 and 24 each extend at an upward angle through the rails to support each rail beneath its center of gravity. For example, the center of gravity 35 of rail 12 (FIG. 2) is located on the center longitudinal axis of the rail with rivets 24 being located at an elevation lower than the center of gravity 35 and as shown in FIG. 2 with the shank of each rivet 24 extending upwardly from a position external of post 14 toward center of gravity 35. Thus, each rivet is located in the lower hemisphere of each rail.

Figure 3:
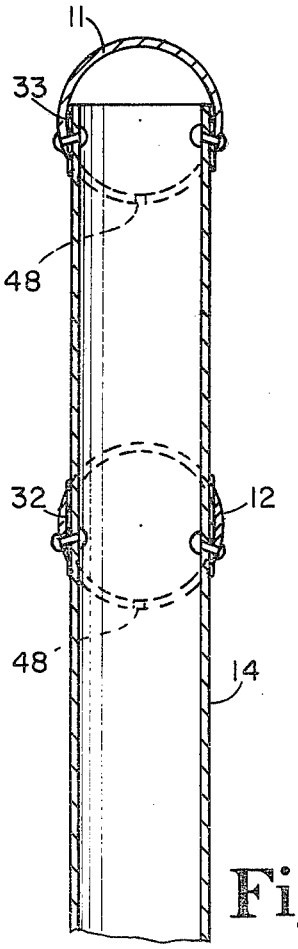
FIG. 3 is the same view as FIG. 2 only showing an alternate embodiment of the gasket disposed in the rail post joint.

The embodiments shown in FIGS. 2 and 3 are identical with the exception of the design of the gasket located between each rail and vertical post. Gaskets 25 and 26 provide a means operable to limit accumulation of rain water between the post and rails and prevent the liquid from entering into the horizontally extending rails. Gasket 25 has a tubular main body 27 having a relatively friction free inwardly facing surface to allow the gasket to be slipped onto the vertical posts. The outwardly facing surface of gasket 25 is positioned against the interior surface of rail 12 limiting relative motion between the gasket and the rail. Further, each gasket 25 has a concave configured top edge 28 and a concave configured bottom edge 29 which conformingly fit to the outside diameter of rail 12. Each edge portion 28 and 29 are positioned at an acute angle relative to the main body 27 of the gasket and abut against the exterior surface of rail 12 providing a tight fit around holes 21 and 22 through which the post extends. Rivets 24 extend through the rail, gasket and vertical post. A gasket may first be fitted into holes 21 and 22 or in other words mounted to the horizontally extending rail and then slipped with the rail onto the vertical post.

The top gaskets 26 are identical in configuration to gaskets 25 with the exception that that top edge portion 30 is straight and perpendicularly arranged to the vertical post. The tubular main body 27 of both gasket 25 and 26 is cylindrical in configuration and parllel to the vertical post. The gaskets may be made from a flexible non-metallic waterproofing material such as plastic and of an appropriate color to match the finish of the rails and posts. The gaskets occupy the space between the rails and posts precluding accumulation of water.

Gaskets 32 and 33 shown in FIG. 3 are identical to gaskets 25 and 26 with the exception that the gaskets shown in FIG. 3 are not provided with the top and bottom edge portions arranged at an acute angle with the tubular or cylindrical main body of the gasket. Thus, gaskets 32 and 33 do not extend outwardly adjacent the exterior surface of each rail; however, the top and bottom edge portions are cut or contoured in a concave configuration to match the outline of the holes provided in rail 12 and the downwardly opening aperture provided in rail 11.

Figure 4:
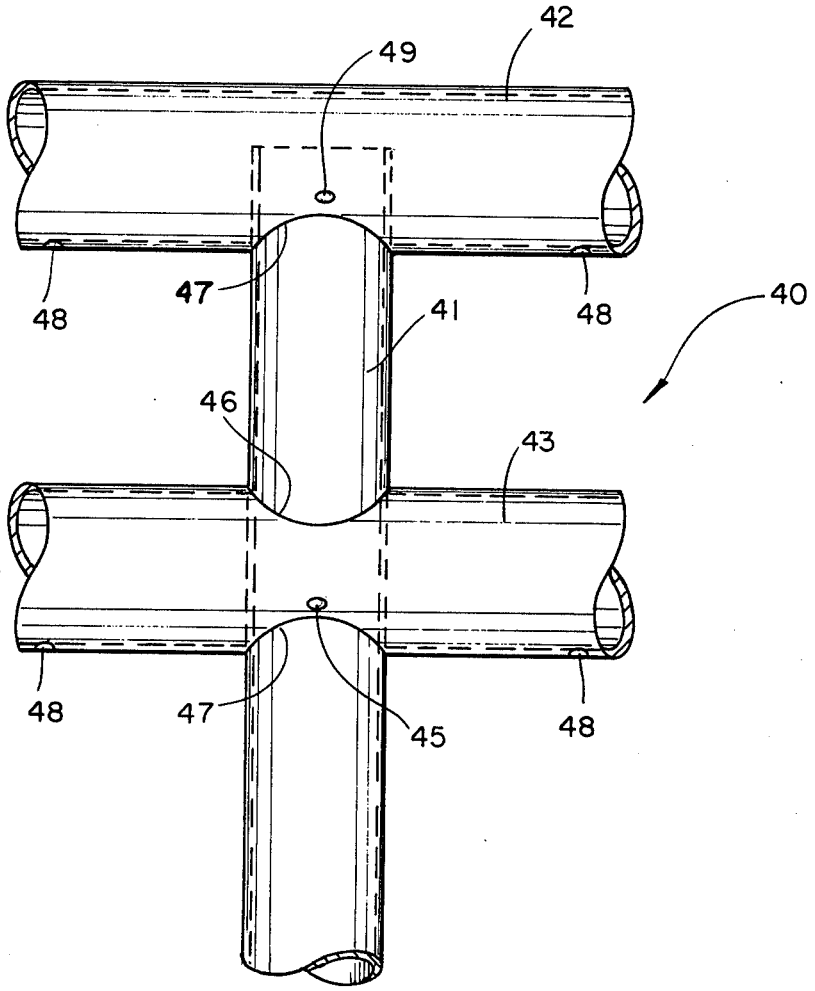
FIG. 4 is a fragmentary side view of an alternate embodiment of the railing system.

An alternate embodiment is shown in FIG. 4 and is identical to the embodiment shown in FIGS. 2 and 3 with the exception that a gasket is not provided between the rails and posts and instead the rails are spaced slightly apart from the post at the junction thereof to allow rainwater to drain therethrough. Further, a pair of drain holes are provided in each rail on the opposite side of each post to allow any water contained within the rail to drain therefrom.

Railing system 40 includes a plurality of vertical posts one of which is shown in FIG. 4 as post 41 having a plurality of rails 42 and 43 fixedly mounted thereto by rivets 49 and 45 in the same manner as that previously disclosed for the embodiments of FIGS. 2 and 3. The lower concave edge portion 47 of rails 42 and 43 are spaced slightly outwardly of the exterior surface of posts 41. Likewise, the concave upward edge portion 46 of rail 43 is spaced slightly outwardly of the exterior surface of rail 41 allowing any water within rail 42 to drain downwardly between edge 47 and post 41 and further allowing any water entering rail 43 between edge 46 and post 41 to drain downwardly and out of the rail between edge 47 and post 41. In addition, a pair of drain holes 48 are provided approximately one foot on either side of post 41 in both rail 42 and 43 to allow any water accumulated within the rail to drain therefrom. Thus, the outwardly spacing of the concave edge portions 46 and 47 along with the drain holes 48 provide a means to limit accumulation of rain water between the post and the rails.

The rails, post and any bends utilized in the railing system are provided from 6063 alloy, extruded aluminum pipe with the remaining aluminum parts produced from 6063 alloy or 6061 alloy with cast bases of 214 alloy. The fasteners are produced from 304 stainless steel. In the embodiment shown in the drawings, the exposed aluminum was anodized with a clear architectural anodic coating thickness of 0.007 mil in according with the Aluminum Association designation AA-M32-C22-A41. The horizontal rails and vertical posts are each produced in a single unspliced or one piece length. In one embodiment, the horizontal rails are one and one-half inch aluminum pipe with a scheduled 40 wall thickness whereas the posts are one and one-quarter inch schedule 80 aluminum pipe. Typically, the posts are spaced apart eight feet center to center.

By preventing accumulation of water within the railing system, the subsequent buildup of ice in cold weather resulting in rupture to a particular rail or post is prevented. Further, the gaskets allow the post to be slipped through the holes in the rails without scratching the anodized surface. In one embodiment, the gasket is provided with a silicone covering.

A particular advantage of the railing disclosed herein is the visual appearance or arrangement of the posts and rails. More specifically, the vertical posts do not visually terminate the horizontal rail and as a result the rails flow through the length of the railing system. The gaskets may each be produced in one integral piece or may be a flat piece having the opposite longitudinally extending edges secured together by suitable adhesive thereby forming the tubular configuration. It will be obvious from the above description that the present invention provides a new and improved railing system. It will be further obvious that the railing system disclosed herein is particularly easy to assembly as compared to the prior art systems.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A railing system comprising:

a plurality of upstanding tubular posts with bottom ends fixedly mountable at a support base level and top ends located thereabove, each of said posts having a constant outside diameter along its entire length and being of one piece construction along its entire length;

a plurality of horizontally extending rails including an upper most rail having downwardly opening apertures complementary in size and receiving said top ends of said posts, each rail beneath said uppermost rail including pairs of holes complementary in size to and through which said posts vertically extend, each of said rails having a constant outside diameter along its entire length and being of one piece construction along its entire length;

first rivets securing said uppermost rail to said top ends of said posts;

second rivets securing each rail beneath said uppermost rail to said posts between said top ends and said bottom ends; and, means opposite to limit accumulation of rain water between said posts and said rails and wherein:

said means including a plurality of flexible gasket sleeves each slidably mounted to a post and fitted into said rails at said apertures and said holes occupying space between and sealing together said rails and said post;

said sleeves having an inwardly facing friction free surface to slip relative to said post and an outwardly facing friction surface limiting relative motion between said rails and said sleeves;

said sleeves including a concave bottom edge portion to conformingly fit to said outside diameter of said rails;

said sleeves positioned in said apertures include a straight top edge portion perpendicularly arranged to said posts;

said sleeves positioned in said holes include a concave top edge portion to conformingly fit to said outside diameter of said rails.

2. The railing system of claim 1 wherein said means includes a plurality of water drain holes to allow any water between said rails and said posts to drain therefrom.

3. The railing system of claim 2 wherein said sleeves include a cylindrical wall parallel to said posts and an edge portion acutely arranged to said cylindrical wall and extending outwardly of and against said rails surrounding at least one of said holes.

4. A railing system comprising:

a plurality of upstanding tubular posts with bottom ends fixedly mountable at a support base level and top ends located thereabove, each of said posts having a constant outside diameter along its entire length and being of one piece construction along its entire length;

a plurality of horizontally extending rails including an upper most rail having downwardly opening apertures complementary in size and receiving said top ends of said posts, each rail beneath said uppermost rail including pairs of holes complementary in size to and through which said posts vertically extend, each of said rails having a constant outside diameter along its entire length and being of one piece construction along its entire length;

first rivets securing said uppermost rail to said top ends of said posts;

second rivets securing each rail beneath said uppermost rail to said posts between said top ends and said bottom ends; and, means operable to limit accumulation of rain water between said posts and said rails and wherein:

said first rivets and second rivets extend at an upward angle through said rails supporting said rails beneath the center of gravity of each rail.

5. A railing system comprising:

a plurality of upstanding tubular posts with bottom ends fixedly mountable at a support base level and top ends located therebove, each of said posts having a constant outside diameter along its entire length and being of one piece construction along its entire length;

a plurality of horizontally extending rails including an upper most rail having downwardly opening apertures complementary in size and receiving said top ends of said posts, each rail beneath said uppermost rail including pairs of holes complementary in size to and through which said posts vertically extend, each of said rails having a constant outside diameter along its entire length and being of one piece construction along its entire length;

first rivets securing said uppermost rail to said top ends of said posts;

second rivets securing each rail beneath said uppermost rail to said posts between said top ends and said bottom ends; and wherein:

said first rivets and second rivets extend at an upward angle through said rails supporting said rails beneath the center of gravity of each rail.

6. The railing system of claim 5 and further comprising a plurality of flexible gasket sleeves each slidably mounted to a post and fitted into said rails at said apertures and said holes occupying space between and sealing together said rails and said posts.

7. The railing system of claim 6 wherein said sleeves have an inwardly facing friction free surface to slip relative to said post and an outwardly facing friction surface limiting relative motion between said rails and said sleeves.

8. The railing system of claim 7 wherein said sleeves include a concave bottom edge portion to conformingly fit to said outside diameter of said rails.

9. A railing system comprising:

a plurality of upstanding tubular posts with bottom ends fixedly mountable at a support base level and top ends located thereabove, each of said posts having a constant outside diameter along its entire length and being of one piece construction along its entire length;

a plurality of horizontally extending rails including an upper most rail having downwardly opening apertures complementary in size and receiving said top ends of said posts, each rail beneath said uppermost rail including pairs of holes complementary in size to and through which said posts vertically extend, each of said rails having a constant outside diameter along its entire length and being of one piece construction along its entire length;

first rivets securing said uppermost rail to said top ends of said posts;

second rivets securing each rail beneath said uppermost rail to said posts between said top ends and said bottom ends;

a plurality of flexible gasket sleeves each slidably mounted to a post and fitted into said rails at said apertures and said holes occupying space between and sealing together said rails and said posts, said sleeves positioned in said apertures including a straight top edge portion perpendicularly arranged to said post and said sleeves positioned in said holes including a concave top edge portion to conformingly fit to said outside diameter of said rails.

10. The railing system of claim 9 wherein said sleeves have an inwardly facing friction free surface to slip relative to said post and an outwardly facing friction surface limiting relative motion between said rails and said sleeves.

11. The railing system of claim 10 wherein said first rivets and second rivets extend at an upward angle through said rails supporting said rails beneath the center of gravity of each rail.

* * * * *